US009339673B2

(12) United States Patent
Shipman

(10) Patent No.: US 9,339,673 B2
(45) **Date of Patent: *May 17, 2016**

(54) FLEXIBLE DRY SPRINKLER

(75) Inventor: Buddy Clayton Shipman, Heath, TX (US)

(73) Assignee: VICTAULIC COMPANY, Easton, PA (US)

( * ) Notice: Subject to any disclaimer, the term of this patent is extended or adjusted under 35 U.S.C. 154(b) by 47 days.

This patent is subject to a terminal disclaimer.

(21) Appl. No.: 13/480,786

(22) Filed: May 25, 2012

(65) Prior Publication Data

US 2012/0298382 A1 Nov. 29, 2012

Related U.S. Application Data

(60) Provisional application No. 61/619,899, filed on Apr. 3, 2012, provisional application No. 61/490,737, filed on May 27, 2011.

(51) Int. Cl.

| | |
|---|---|
| ***A62C 35/62*** | (2006.01) |
| ***A62C 35/64*** | (2006.01) |
| ***A62C 35/68*** | (2006.01) |
| ***A62C 37/11*** | (2006.01) |
| ***A62C 37/14*** | (2006.01) |
| ***A62C 3/00*** | (2006.01) |
| *A62C 37/48* | (2006.01) |

(52) U.S. Cl.

CPC ..... *A62C 35/62* (2013.01); *A62C 3/004* (2013.01); *A62C 35/645* (2013.01); *A62C 35/68* (2013.01); *A62C 37/11* (2013.01); *A62C 37/14* (2013.01); *A62C 37/48* (2013.01)

(58) Field of Classification Search

CPC ..... A62C 31/02; A62C 35/62; A62C 37/11; A62C 37/12; A62C 37/14; A62C 37/16

USPC ..... 169/16, 17, 37–41, 56–59, DIG. 3

See application file for complete search history.

(56) References Cited

U.S. PATENT DOCUMENTS

| | | | | |
|---|---|---|---|---|
| 2,155,990 | A * | 4/1939 | Hodgman, Jr. | 169/39 |
| 2,871,953 | A | 2/1959 | Bray | |
| 3,135,331 | A | 6/1964 | Lee | |
| 3,309,028 | A | 3/1967 | Zieg et al. | |
| 3,584,689 | A | 6/1971 | Willms | |
| 3,616,860 | A | 11/1971 | Williams | |
| 3,949,812 | A | 4/1976 | Hay | |

(Continued)

FOREIGN PATENT DOCUMENTS

| | | |
|---|---|---|
| CN | 2380254 Y | 5/2000 |
| DE | 39 19 638 C1 | 11/1990 |

(Continued)

OTHER PUBLICATIONS

Mar. 18, 2014 Office Action issued in U.S. Appl. No. 13/176,834.

(Continued)

*Primary Examiner* — Darren W Gorman

(74) *Attorney, Agent, or Firm* — Oliff PLC

(57) ABSTRACT

An X-brace configuration locks a valve element in a latched position until a fusible element breaks releasing pressurized inert gas. Upon depressurization, the X-brace configuration releases the valve element to open and allow water flow through the flexible sprinkler assembly.

20 Claims, 6 Drawing Sheets

(56) References Cited

U.S. PATENT DOCUMENTS

| | | | | |
|---|---|---|---|---|
| 4,177,862 | A | 12/1979 | Bray | |
| 4,220,208 | A | 9/1980 | Jackson et al. | |
| 4,305,469 | A | 12/1981 | Morrisette | |
| 4,648,460 | A | 3/1987 | McCulloch | |
| 5,188,184 | A | 2/1993 | Northill | |
| 5,396,959 | A | 3/1995 | Macdonald | |
| 5,415,239 | A | 5/1995 | Kotter et al. | |
| 5,533,576 | A | 7/1996 | Mears | |
| 5,570,745 | A | 11/1996 | MacDonald, III | |
| 5,743,337 | A | 4/1998 | MacDonald, III | |
| 5,775,431 | A | 7/1998 | Ondracek | |
| 5,967,237 | A | 10/1999 | Sundholm | |
| 5,967,240 | A | 10/1999 | Ondracek | |
| 6,024,175 | A | 2/2000 | Moore, Jr. et al. | |
| 6,105,678 | A * | 8/2000 | Tsai | 169/54 |
| 6,119,784 | A | 9/2000 | MacDonald, III et al. | |
| 6,158,519 | A | 12/2000 | Kretschmer | |
| 6,293,348 | B1 | 9/2001 | Reilly | |
| 6,340,058 | B1 | 1/2002 | Dominick et al. | |
| 6,484,513 | B1 | 11/2002 | Chou | |
| 6,536,533 | B2 | 3/2003 | Reilly | |
| 6,666,277 | B2 | 12/2003 | Reilly | |
| 6,691,790 | B1 | 2/2004 | MacDonald, III et al. | |
| 6,708,771 | B2 | 3/2004 | Reilly | |
| 6,851,482 | B2 | 2/2005 | Dolan | |
| 7,055,612 | B2 | 6/2006 | Jackson et al. | |
| 7,185,711 | B2 | 3/2007 | Jackson et al. | |
| 7,213,319 | B2 | 5/2007 | Silva, Jr. et al. | |
| 7,373,720 | B1 * | 5/2008 | Jensen et al. | 29/890.143 |
| 7,416,030 | B2 | 8/2008 | Lupien et al. | |
| 7,516,800 | B1 * | 4/2009 | Silva et al. | 169/37 |
| 7,644,736 | B2 | 1/2010 | Bittenbender et al. | |
| 7,766,252 | B2 | 8/2010 | Jackson et al. | |
| 7,823,650 | B2 | 11/2010 | Eckholm et al. | |
| 8,127,860 | B2 | 3/2012 | Golinveaux | |
| 2002/0003042 | A1 | 1/2002 | Reilly | |
| 2002/0011342 | A1 | 1/2002 | Reilly | |
| 2002/0050531 | A1 | 5/2002 | Dolan | |
| 2002/0121381 | A1 | 9/2002 | Reilly | |
| 2003/0075343 | A1 | 4/2003 | Ballard | |
| 2004/0011537 | A1 | 1/2004 | Jackson et al. | |
| 2004/0123989 | A1 * | 7/2004 | Sprakel et al. | 169/5 |
| 2005/0121206 | A1 | 6/2005 | Dolan | |
| 2009/0008104 | A1 | 1/2009 | MacDonald, III et al. | |
| 2010/0038099 | A1 * | 2/2010 | Thompson et al. | 169/37 |
| 2011/0315407 | A1 | 12/2011 | Park et al. | |
| 2012/0097406 | A1 * | 4/2012 | Silcox et al. | 169/51 |
| 2012/0132444 | A1 | 5/2012 | Buzdum et al. | |
| 2012/0298382 | A1 | 11/2012 | Shipman | |
| 2012/0298383 | A1 | 11/2012 | Shipman | |
| 2013/0199803 | A1 * | 8/2013 | Multer | 169/17 |

FOREIGN PATENT DOCUMENTS

| | | | |
|---|---|---|---|
| EP | 1 368 589 | A2 | 12/2003 |
| EP | 2 623 161 | A2 | 8/2013 |
| JP | H06-170008 | A | 6/1994 |
| KR | 10-2012-0098205 | B1 | 9/2012 |
| KR | 2012 0098205 | A | 9/2012 |
| KR | 10-1259098 | A | 5/2013 |
| WO | 02/070071 | A2 | 9/2002 |
| WO | WO 2012/166636 | A1 | 12/2012 |
| WO | WO 2012/166644 | A1 | 12/2012 |

OTHER PUBLICATIONS

Aug. 7, 2014 Search Report issued in PCT Application No. PCT/US2013/052835.
Sep. 29, 2014 Office Action issued in U.S. Appl. No. 13/176,834.
Oct. 31, 2014 Office Action issued in New Zealand Patent Application No. 618905.
Mar. 27, 2015 Office Action issued in U.S. Appl. No. 13/176,834.
Apr. 22, 2015 Extended European Search Report issued in Application No. 12792109.6.
May 11, 2015 Search Report issued in European Application No. 12793586.4.
May 6, 2015 Office Action issued in Chinese Patent Application No. 201280037396.6.
Jul. 2, 2015 International Preliminary Report on Patentability issued in Application No. PCT/US2013/052835.
Jul. 16, 2015 Office Action issued in U.S. Appl. No. 13/176,834.
Nov. 30, 2015 Office Action issued in U.S. Appl. No. 13/722,571.
Jan. 25, 2016 Office Action issued in U.S. Appl. No. 13/176,834.

* cited by examiner

FLEXIBLE DRY SPRINKLER

CROSS REFERENCE TO RELATED APPLICATIONS

The present application claims the benefit under 35 U.S.C. §119(e) of U.S. Provisional Patent Application Ser. No. 61/619,899 filed Apr. 3, 2012 and entitled "X-Brace Valve and Flexible Connection for Fire Sprinklers," and U.S. Provisional Patent Application Ser. No. 61/490,737 filed May 27, 2011 and entitled "Flexible or Straight Dry Pendent Fire Sprinkler Hose with Xbrace," each of which is incorporated herein by reference for all purposes.

TECHNICAL FIELD

The present disclosure relates generally to fire sprinkler systems, and in particular, to an X-brace valve and flexible dry sprinkler assembly.

BACKGROUND

Prior art conventional dry barrel sprinklers for use in commercial fire sprinkler systems are sold to fire system installers in fixed lengths. The installer has to first install branch line piping for a sprinkler system and then measure a suitable length for dry barrel fire sprinklers for installation. An installer will order fire sprinklers for the installation according to the lengths measured. Delivery typically takes seven to ten business days, which delays installation and completion of construction projects. Longer delays occur if mistakes are made in measuring and the fire sprinklers have to be reordered in a different length.

Dry fire sprinkler systems often deteriorate rapidly due to condensation being trapped in such systems. With rigid dry sprinkler systems, an increased number of fittings is often required to route rigid piping from a branch line to a desired fire sprinkler assembly location. This increase in the number of fittings results in providing additional places where condensation may collect without being able to drain. Additionally, dry fire sprinkler systems can be filled with air or inert gas, which is expelled during operation of such systems. The response time for expelling air or inert gas from the system and providing water to a fire zone is critical for containing a fire. With additional piping and fittings required for routing dry fire sprinkler systems, the volume required for evacuation and filling with water is increased.

SUMMARY

Embodiments of the present disclosure generally provide a flexible dry sprinkler assembly system.

An X-brace valve and flexible connection for fire sprinklers are disclosed. The X-brace is included in a flexible fire sprinkler assembly, but may also be used in rigid sprinkler installations. The flexible fire sprinkler assembly is a pendent dry fire sprinkler assembly, which has a flexible body structure, constructed of corrugated or braided hose similar to that commonly used for plumbing household clothes washing machines. A sprinkler nozzle can be secured to a first end of the conduit, which is provided by a flexible hose. The sprinkler nozzle has a first fitting, a sprinkler orifice and fusible element. The fusible element is provided by a fluid filled glass bulb, which will break when ambient temperatures reach a predetermined temperature. A second fitting is secured to a second end of the flexible conduit, and a valve is mounted to the second fitting. The valve includes a valve element, which is pivotally mounted to the second fitting and moveable from a latched position to an unlatched position. Breaking of the fusible element releases any inert gas inside the conduit. Upon depressurization, the X-brace configuration releases the valve element to open and allow water flow through the flexible sprinkler assembly.

BRIEF DESCRIPTION OF THE DRAWINGS

For a more complete understanding of the present disclosure and its features, reference is now made to the following description, taken in conjunction with the accompanying drawings, in which.

DETAILED DESCRIPTION

The present disclosure generally provides an X-brace valve and a flexible hose connection for fire sprinklers.

Figure 1:
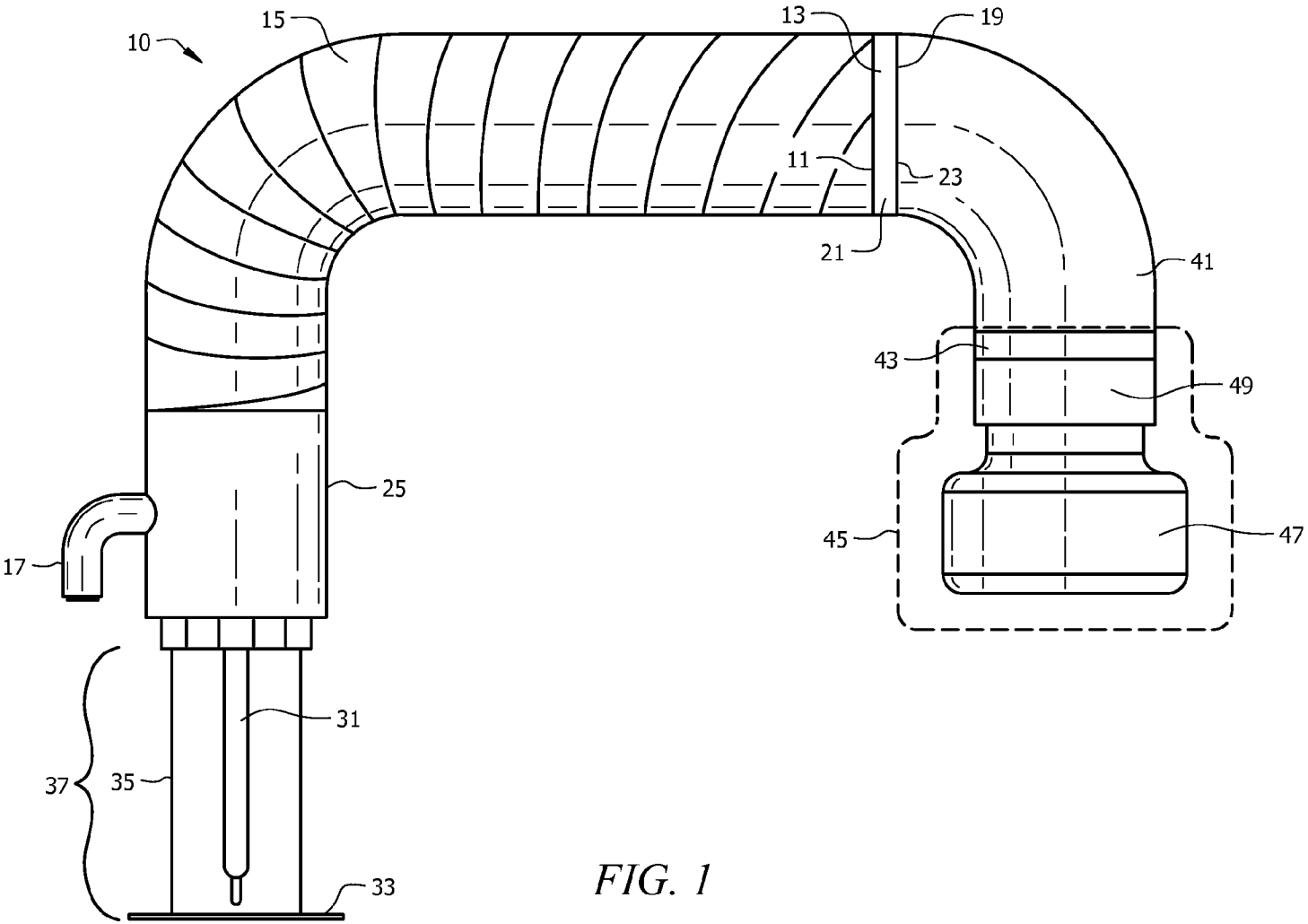
FIG. 1 is a side elevation view and partial cut-away view of a dry flexible fire sprinkler assembly made according to one embodiment of the present disclosure.

FIG. 1 illustrates a dry flexible fire assembly system 10 according to one embodiment of the present disclosure. It should be understood that system 10 shown in FIG. 1 is for illustrative purposes only and that any other suitable system or subsystem could be used in conjunction with or in lieu of system 10 according to one embodiment of the present disclosure.

In an embodiment, system 10 may comprise a valve 11 with an X-brace latch 13, a conduit 15 and an insert pipe 17.

In an embodiment, the valve 11 is a swing check valve, such as a clapper valve, and includes a swing-type valve element 19, such as a clapper, for angularly moving to engage a seal 21 against a seal seat 23. An X-brace valve latch 13 may be used to secure the valve element 19 in a latched position until the system is exposed to a predetermined temperature.

In an embodiment, the conduit 15 may be flexible and formed with an outer cover of braided metal. A sprinkler nozzle 25 may be mounted to a first end of the conduit 15 and a connector fitting 43 is mounted to a second end of the conduit 15. The sprinkler nozzle 25 may include a fitting 27, a sprinkler orifice 29 and a fusible element 31, such as a fluid filled glass bulb, as is conventionally used in other sprinkler assemblies.

Valve 11 is provided between the connector fitting 43 and the conduit 15. The connector fitting 43 is secured to the second end of the conduit 15 with an elbow fitting therebetween. The connector fitting 43 connects or otherwise couples the system 10 to a pipe T 45 in a sprinkler branch line 47. A connector coupling 49 secures the connector fitting 43 to the pipe T 45.

System 10 may further comprise an insert pipe 17. In an embodiment the insert pipe 17 may be connected to or otherwise coupled to system 10 through the conduit 15 or a sprinkler nozzle 25. In other embodiments, the insert pipe 17 may be integrally formed with system 10.

System 10 may also include a diffuser 33, or spray plate, and support arms 35.

In one embodiment, air, nitrogen, other suitable inert gases, or a combination thereof may be introduced into system 10 through the insert pipe 17 to inflate and pressurize the conduit 15. The pressure created by the introduction of a suitable gas would cause pressure to be exerted on the valve 11, which would hold closed the X-brace valve latch 13 and the valve element 19.

The valve 11, which engages the pressurized gas, may have an interior surface area larger than the seal seat 23, which engages the pressurized water. In such embodiments, a surface differential method (utilizing pressure X surface area=force) is employed to operate the system 10. The seal seat 23, having less interior surface area, requires increased force of fluid pressure to open.

In operation, when the system 10 is exposed to a predetermined temperature, the fusible element 31 will break and expel the pressurized inert gas, thereby unlatching X-brace valve latch 13 and valve element 19 and allowing the pressurized water to flow from system 10.

In operation, air, nitrogen, other suitable inert gases, or a combination thereof may be introduced into system 10 prior to installation or after installation through insert pipe 17 or by other suitable method. Additionally, air, nitrogen, other suitable inert gases, or a combination thereof may be reintroduced into system 10 through insert pipe 17 as desired to achieve the desired pressure.

In alternative embodiments, antifreeze solution, other suitable liquids, or a combination thereof may be introduced into system 10 through insert pipe 17.

In alternative embodiments, the X-brace valve latch and/or the valve element 19 of the present disclosure may also be used in wet sprinkler installations and in rigid sprinkler assemblies. For rigid sprinkler assemblies, the conduit 15 may be replaced with a rigid tubular member, such as a pipe or tubing.

In operation, employing the mechanics of system 10 in rigid sprinkler assemblies may allow a less expensive manufacturing option.

In an embodiment, sprinkler nozzle 25, fusible element 31, diffuser 33 and support arms 35 (the "sprinkler head 37") may be replaceable without having to replace other elements of system 10. After the pressurized inert gas is released, the sprinkler head 37 may be replaced. The system 10 may then be re-pressurized to the desired pressure by introducing air, nitrogen, other inert gases, or a combination thereof through insert pipe 17.

In other embodiments, the sprinkler head 37 may be replaced without having to release the pressurized gas from system 10.

Figure 2:
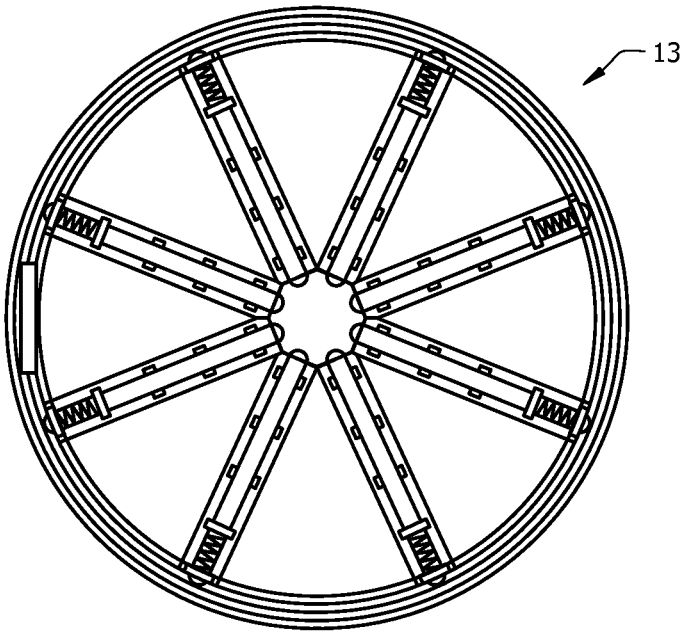
FIG. 2 is a sectional view of the flexible fire sprinkler assembly of FIG. 1, taken along section 2-2 of FIG. 1, and shows a frontal elevation view of an X-brace valve latch in a latched position, according to one embodiment of the present disclosure.

FIG. 2 is a sectional view of the flexible sprinkler assembly 12 of FIG. 1, taken along the section line 2-2 of FIG. 1, and shows a frontal elevation view of an X-brace type valve latch 13 in an unlatched position.

Figure 3:
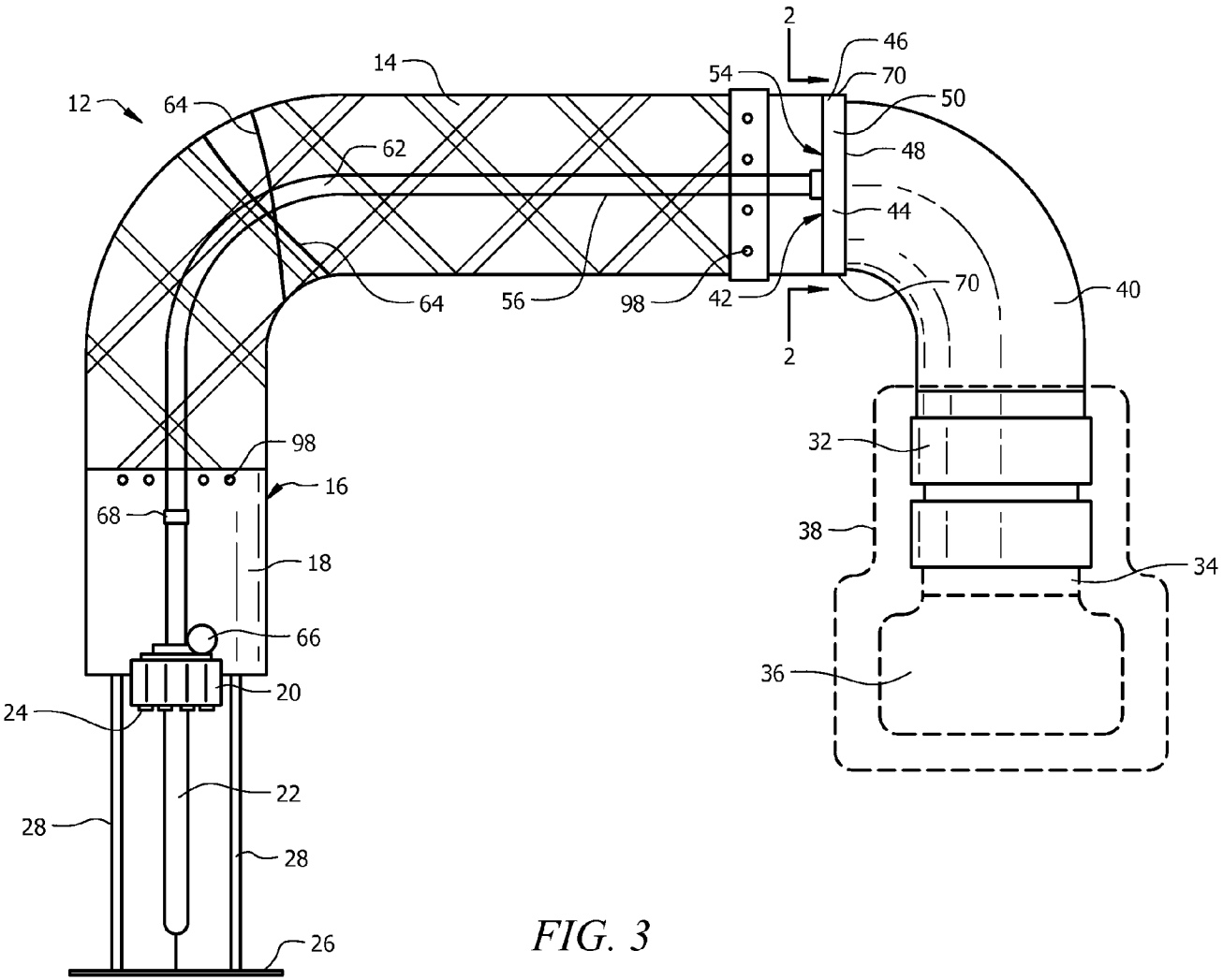
FIG. 3 is a side elevation view and partial cut-away view of a dry flexible fire sprinkler assembly made according to a second embodiment of the present disclosure.

FIG. 3 illustrates a dry flexible fire assembly system 12 according to one embodiment of the present disclosure. It should be understood that the system 12 shown in FIG. 3 is for illustrative purposes only and that any other suitable system or subsystem could be used in conjunction with or in lieu of system 12 according to one embodiment of the present disclosure.

In one embodiment, system 12 could generally be similar to system 10 shown in and described in conjunction with FIGS. 1-2 above (with like parts having similar numbers).

In an embodiment, system 12 may comprise a valve 42 with an X-brace latch 54, and a flexible conduit 14.

Flexible conduit 14 may be formed with an outer cover of braided metal. In an embodiment, a sprinkler nozzle 16 is mounted to a first end of the flexible conduit 14 and a connector fitting 32 is mounted to a second end of the conduit 14. The sprinkler nozzle 16 may include a fitting 18, a sprinkler orifice 20 and a fusible element 22, such as a fluid filled glass bulb, as is conventionally used in other sprinkler assemblies. In an embodiment, the fusible element 22 breaks when exposed to a predetermined temperature.

The connector fitting 32 is secured to the second end of the flexible conduit 14 with an elbow fitting 40 therebetween. The connector fitting 32 connects or otherwise couples the sprinkler assembly 12 to a pipe T 34 in a sprinkler branch line 36. A connector coupling 38 secures the fitting 32 to the pipe T 34.

Valve 42 is provided between the connector fitting and the flexible conduit 14. In an embodiment, the valve 42 is a swing check valve, such as a clapper valve, and includes a swing-type valve element 44, such as a clapper, mounted by means of a pivot 46 for angularly moving to engage a seal 48 against a seal seat 50. An X-brace valve latch 54 may be used to secure the valve element 44 in a latched position until the system is exposed to a predetermined temperature. When the system is exposed to a predetermined temperature, the fusible element will break engaging the sprinkler assembly 12 and initiating water flow.

In an embodiment, a flexible link 56 extends from the valve latch 54 to the sprinkler nozzle 16. The flexible link 56 may be used in conjunction with or separate and apart from system 10 of FIG. 1.

A first end of the flexible link 56 has a link pin for fitting into the valve latch 54, as described herein, to secure the valve latch 54 in a latched position. A second end of the flexible link 56 has a plug adapter 60 for securing the flexible link 56 to the sprinkler plug 24. An intermediate portion 62 of the flexible link 56 connects the plug adapter 60 to the link pin 58, and centralizer braces 64 may be used to center the flexible link 56 within the flexible conduit 14.

When the fusible element 22 breaks and engages the system, sprinkler plug 24 will release and allow downward movement of the flexible link 56.

A bias member 66, provided by a torsion spring, may be connected between the fitting 18 and the orifice 20 and the flexible link 56. A coupler 68 secures the flexible link 56 to a run-out end of the bias member 66. The bias member 66 provides a motive force for moving the flexible link 56 downward to pull the link pin 58 from within the valve latch 54.

A portion of the fitting 40 adjacent the valve latch 54 has an undercut 70. The undercut 70 may be provided by a circumferentially extending groove, or by apertures formed radially into a first end of the fitting 40 to extend along a circumference of the fitting 40, in an angularly spaced, diametrically opposed arrangement.

In an embodiment, system 12 may further comprise vent holes 98 in the fitting 18 and the elbow fitting 40. Vent holes 98 may be employed to allow moisture to drain from within the system 12.

In some embodiments, air, nitrogen, other inert gases, or a combination thereof may be sealed within the system 12 to prevent moisture from being retained within the system 12, rather than employing the vent holes 98.

The air, nitrogen, other inert gases, or a combination thereof introduced and sealed within the system may be pressurized. The pressurized inert gas may operate and function similarly to the pressurized inert gas described in system 10 of FIG. 1. Additionally, in some embodiments, the pressurized inert gas and the flexible link 56 may act as a primary actuation and a secondary actuation for system 12.

Air, nitrogen, other inert gases, or a combination thereof may be introduced into system 12 prior to installation or after installation.

System 12 may also include a diffuser 26, or spray plate, and support arms 28.

Figure 4:
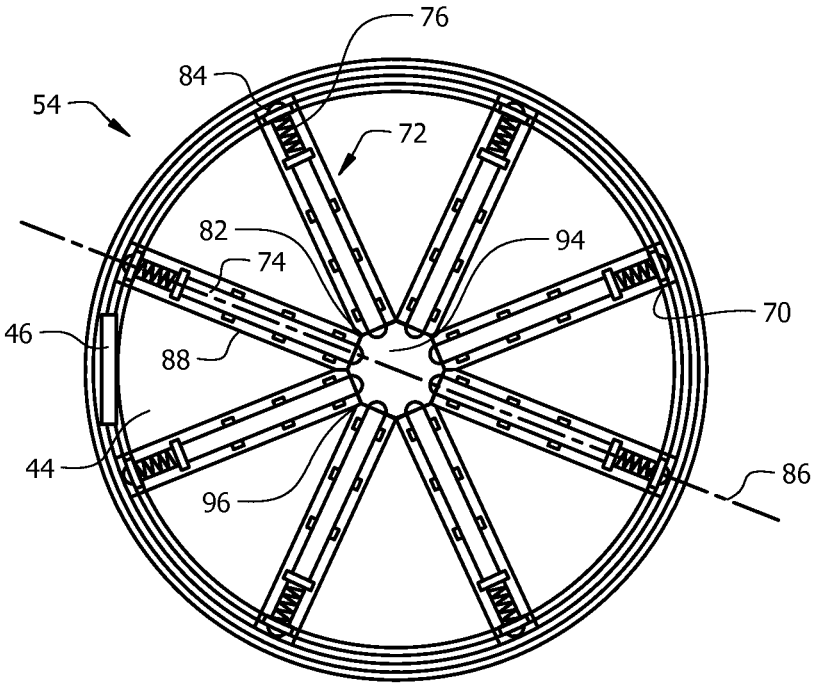
FIG. 4 is a sectional view of the flexible fire sprinkler assembly of FIG. 3, taken along section line 2-2 of FIG. 3, and shows a frontal elevation view of an X-brace valve latch in an unlatched position, according to one embodiment of the present disclosure.
Figure 5:
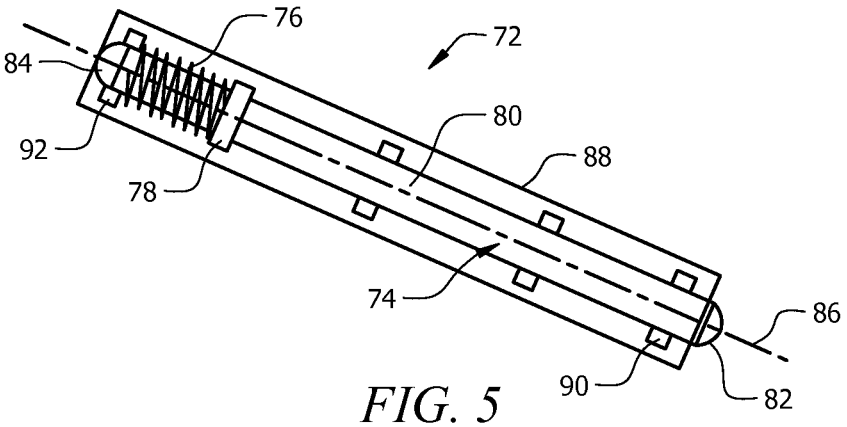
FIG. 5 is a side elevation view of a slider lock of the X-brace valve latch of FIG. 4, and shows the slider lock in a released position, according to one embodiment of the present disclosure.

FIG. 4 is a sectional view of the flexible sprinkler assembly 12 of FIG. 3, taken along the section line 2-2 of FIG. 3, and shows a frontal elevation view of an X-brace type valve latch 54 in an unlatched position. FIG. 5 is a side elevation view of a slider lock 72 of FIG. 4, and shows the lock pin 74 in a released position.

The valve latch 54 is shown having eight slider locks 72 arranged with respective longitudinal axes 86 in an angularly spaced alignment, with the longitudinal axes disposed at equally angular distances about a central point of a brace eye 94. In alternative embodiments, the number of slider locks 72 may be increased or decreased as desired.

The brace eye 94 defines a centrally disposed section of the valve latch 54, defined within a link pin guide 96 to which first ends of the brace arms 88 are fixedly secured.

The slider locks 72 each may have a brace arm 88 and lock pin 74. In some embodiments, the brace arms 88 may be integrally formed as part of the valve element 44.

The lock pins 74 have an elongate stem 80, with a follower end 82 and a protuberant end 84. In an embodiment, the follower end 82 and the protuberant end 84 are round. A fixed shoulder 78 is connected to the protuberant end 84 of the slider lock 72. A bias member 76 is provided by a wound coil spring for extending between the fixed shoulder 78 and a stop 92 provided on the brace arm 88, such that the lock pin 74 is urged to move away from the protuberant end 84 toward the follower end 82.

The brace arms 88 may further include retainers 90 for slidably securing the lock pins 74 to the brace arms 88. When the link pin 58 is not disposed within the brace eye 94, the lock pins 74 are free to move towards follower ends 82 of respective ones of the slider locks 72 and the associated brace arms 88, such that follower ends 82 protrude into the brace eye 94.

Figure 6:
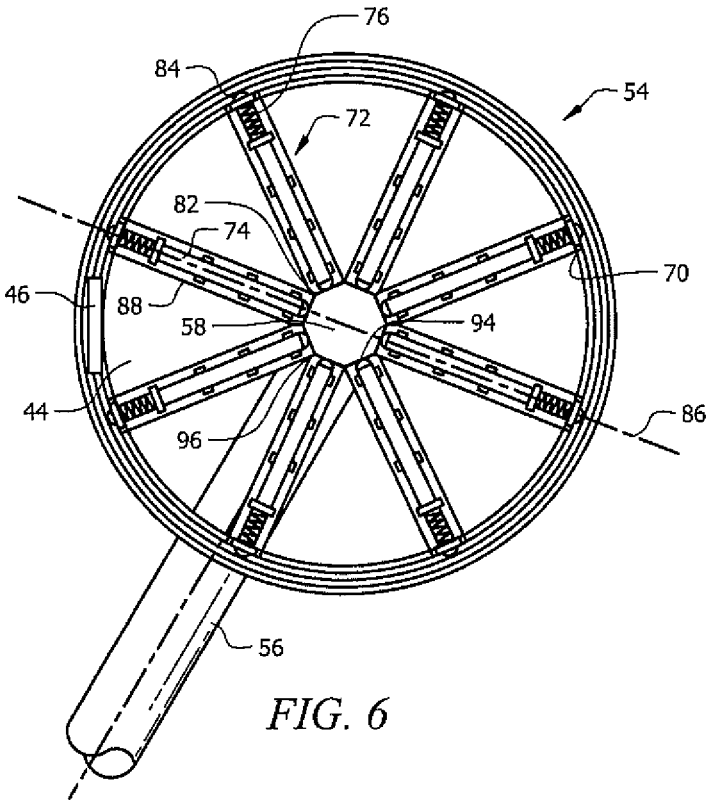
FIG. 6 is a sectional view of the flexible fire sprinkler assembly of FIG. 3, taken along section line 2-2 of FIG. 3, and shows a frontal elevation view of the X-brace valve latch in a latched position, according to one embodiment of the present disclosure.
Figure 7:
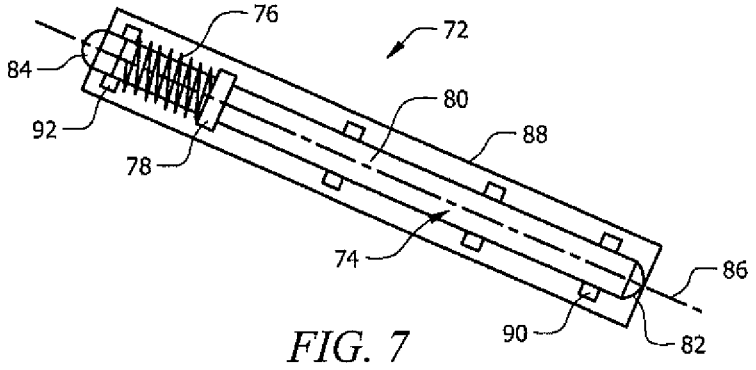
FIG. 7 is a side elevation view of the slider lock of the X-brace valve latch of FIG. 6, and shows the slider lock in a locked position, according to one embodiment of the present disclosure.
Figure 8:
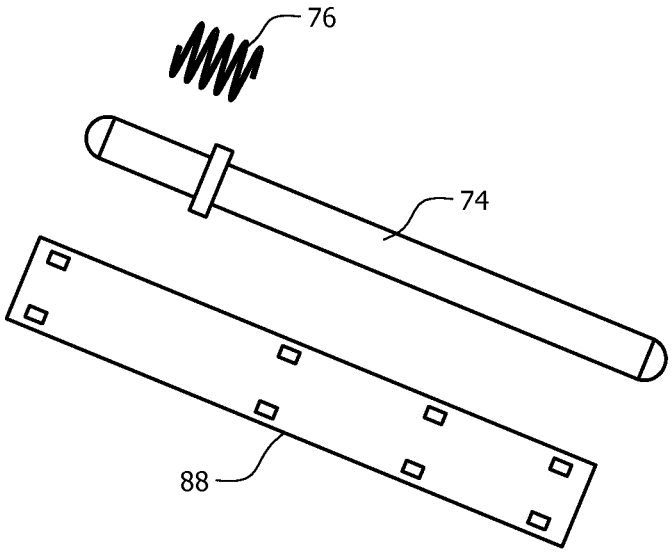
FIG. 8 is an exploded view of the slider lock of FIG. 7 according to one embodiment of the present disclosure.

FIG. 6 is a sectional view of the flexible sprinkler assembly 12 of FIG. 3, taken along section line 2-2 of FIG. 3, and shows a frontal elevation view of the X-brace valve latch 54 in a latched position. FIG. 7 is a side elevation view of a slider lock 72 of FIG. 6, and shows the lock pin 74 in a locked position. FIG. 8 is an exploded view of a brace arm 88 and lock pin 74 of the X-brace latch 54 of FIG. 6.

Referring to FIG. 6, the flexible link 56 is shown in an initial position, as shown previously in FIG. 3, with the link pin 58 engaged within the brace eye 94 of the valve latch 54. In such a position, the link pin 58 pushes the lock pins 74 of the slider locks 72 radially outward from the brace eye 94, which moves the protuberant ends 84 to radially extend into the undercut 70 and secure the valve element 44 in a closed position.

When the link pin 58 is released from within the brace eye 94, the bias members 76 will urge the lock pins 74 to move from locked positions to the released positions, as shown in FIGS. 4-5. The valve element 44 will open under the force of fluid pressure within the sprinkler branch 36.

Figure 9:
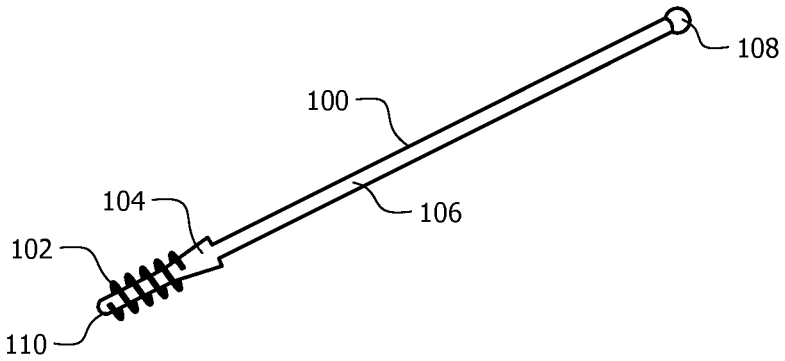
FIG. 9 is a side elevation view of a lock pin according to another embodiment of the present disclosure.

FIG. 9 is a side elevation view of an alternative lock pin 100. The lock pin 100 has a bias member 102 provided by wound coil spring. The lock pin 100 may comprise an elongate stem 106, a follower end 108 and a protuberant end 110. In an embodiment, the follower end 108 and the protuberant end 110 may have rounded ends. A fixed shoulder 104 is provided spaced apart from the protuberant end 110, for receiving the bias member 102 therebetween.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A flexible dry sprinkler head comprising:

a flexible conduit having a first end and a second end, the second end being configured to couple to a fluid supply;

a sprinkler nozzle mounted at the first end of the flexible conduit; and a valve disposed proximate to the second end of the flexible conduit and having an open state and a closed state, the valve configured to allow fluid from the fluid supply to flow through the conduit when the valve is in the open state and to prevent fluid from the fluid supply from flowing through the conduit when the valve is in the closed state;

wherein the flexible conduit is configured to receive and contain pressurized gas, the pressurized gas maintaining the valve in the closed state.

2. The flexible dry sprinkler head of claim 1, wherein the flexible dry sprinkler head is configured such that the pressurized gas is released through the sprinkler nozzle when the sprinkler nozzle opens, which in turn allows the valve to move from the closed state to the open state.

3. The flexible dry sprinkler head of claim 1, wherein the flexible conduit includes a corrugated hose.

4. The flexible dry sprinkler head of claim 3, wherein the flexible conduit includes an outer cover of braided metal.

5. The flexible dry sprinkler head of claim 1, wherein the flexible conduit is capable of being bent at a right angle.

6. The flexible dry sprinkler head of claim 1, wherein the valve is a check valve.

7. The flexible dry sprinkler head of claim 1, wherein the valve is a clapper valve.

8. The flexible dry sprinkler head of claim 1, wherein the sprinkler nozzle includes an element that breaks when exposed to predetermined temperatures.

9. A flexible dry sprinkler head comprising:

a flexible conduit having a first end and a second end, the second end being configured to be coupled to a fluid supply;

a sprinkler nozzle mounted at the first end of the flexible conduit, the sprinkler nozzle including an element that breaks when exposed to predetermined temperatures; and a valve disposed proximate to the second end of the conduit and having an open state and a closed state, the valve configured to allow fluid from the fluid supply to flow through the conduit when the valve is in the open state and to prevent fluid from the fluid supply to flow through the conduit when the valve is in the closed state;

wherein the flexible dry sprinkler head is configured to receive and contain pressurized gas; and wherein the sprinkler nozzle, the valve and the flexible conduit are configured such that breaking of the element releases the pressurized gas which in turn allows the valve to move from the closed state to the open state.

10. The flexible dry sprinkler head of claim 9, wherein the flexible conduit includes a corrugated hose.

11. The flexible dry sprinkler head of claim 10, wherein the flexible conduit includes an outer cover of braided metal.

12. The flexible dry sprinkler head of claim 9, wherein the flexible conduit is capable of being bent at a right angle.

13. The flexible dry sprinkler head of claim 9, wherein the conduit is filled with an inert gas under pressure between the first end and the valve.

14. The flexible dry sprinkler according to claim 9, further comprising a gas inlet for passing gas into the flexible conduit.

15. A flexible dry sprinkler head comprising:

a flexible conduit having a first end and a second end, the second end being configured to couple to a fluid supply;

a sprinkler nozzle mounted at the first end of the flexible conduit; and a valve disposed proximate to the second end of the flexible conduit and having an open state and a closed state, the valve configured to allow fluid from the fluid supply to flow through the conduit when the valve is in the open state and to prevent fluid from the fluid supply from flowing through the conduit when the valve is in the closed state;

wherein the flexible conduit is filled with a liquid having antifreeze characteristics between the first end and the valve, the liquid maintaining the valve in the closed state.

16. The flexible dry sprinkler head of claim 15, wherein the flexible dry sprinkler head is configured such that the liquid passes through the sprinkler nozzle when the sprinkler nozzle opens, which in turn allows the valve to move from the closed state to the open state.

17. The flexible dry sprinkler head of claim 15, wherein the flexible conduit includes a corrugated hose and an outer cover of braided metal.

18. The flexible dry sprinkler head of claim 15, wherein the flexible conduit is capable of being bent at a right angle.

19. The flexible dry sprinkler head of claim 15, wherein the valve is a check valve.

20. A method of fire protection comprising the steps of:

providing a flexible dry sprinkler head comprising:

a flexible conduit having a first end and a second end, the second end being configured to couple to a fluid supply;

a sprinkler nozzle mounted at the first end of the flexible conduit; and a valve disposed proximate to the second end of the flexible conduit and having an open state and a closed state, the valve configured to allow fluid from the fluid supply to flow through the conduit when the valve is in the open state and to prevent fluid from the fluid supply from flowing through the conduit when the valve is in the closed state; and filling the flexible conduit with pressurized gas such that the pressurized gas maintains the valve in the closed state;

wherein the flexible dry sprinkler head is configured to release the pressurized gas when the sprinkler nozzle opens, which allows the valve to open and fluid from the fluid supply to pass through the conduit and out the sprinkler nozzle.

* * * * *